US006360409B1

(12) United States Patent
Wier

(10) Patent No.: US 6,360,409 B1
(45) Date of Patent: Mar. 26, 2002

(54) LOAD-BEARING FRAME OF METAL FOR A VEHICLE SEAT BELT BUCKLE

(75) Inventor: Franz Wier, Göggingen (DE)

(73) Assignee: TRW Occupant Restraint Systems GmbH, Alfdorf (DE)

( * ) Notice: Subject to any disclaimer, the term of this patent is extended or adjusted under 35 U.S.C. 154(b) by 0 days.

(21) Appl. No.: 09/012,870

(22) Filed: Jan. 23, 1998

(30) Foreign Application Priority Data

Jan. 24, 1997 (DE) ..... 297 01 175

(51) Int. Cl.[7] ..... A44B 11/26
(52) U.S. Cl. ..... 24/633; 280/801.1; 24/642
(58) Field of Search ..... 24/633, 637, 639, 24/640, 641, 642, 625, 664; 280/805, 801.1; 297/474

(56) References Cited

U.S. PATENT DOCUMENTS 4,228,567 A * 10/1980 Ikesue et al. ..... 24/642
4,262,396 A * 4/1981 Koike ..... 24/642 X
4,550,474 A * 11/1985 Doty et al. ..... 24/633
4,566,160 A * 1/1986 Gavagan et al. ..... 24/637
4,622,727 A * 11/1986 Wier ..... 24/642
4,702,491 A * 10/1987 Meyer ..... 280/801.1
4,744,134 A * 5/1988 Bétencourt ..... 24/642 X
4,945,617 A * 8/1990 Griffith ..... 24/633
5,359,756 A * 11/1994 Miyauchi et al. ..... 24/633 X
5,377,393 A * 1/1995 Ellis ..... 24/637
5,438,492 A * 8/1995 Collins et al. ..... 24/633 X
5,878,469 A * 3/1999 Wier ..... 24/633

FOREIGN PATENT DOCUMENTS

DE 2825181 12/1979
DE 29517162 3/1996
FR 2615808 12/1988
GB 2173243 A * 10/1986 ..... 24/633

* cited by examiner

*Primary Examiner*—Robert J. Sandy
(74) *Attorney, Agent, or Firm*—Tarolli, Sundhiem, Covell, Tummino & Szabo L.L.P.

(57) ABSTRACT

A load-bearing frame is provided with a fastener extension which is configured integrally with the frame and comprises a fastener opening for mounting the frame in a vehicle-fixed manner.

7 Claims, 5 Drawing Sheets

LOAD-BEARING FRAME OF METAL FOR A VEHICLE SEAT BELT BUCKLE

The invention relates to a load-bearing frame of metal for a vehicle seat belt buckle.

BACKGROUND OF THE INVENTION

Such a frame receives the usual functional parts of a belt buckle, for example a catch for an insert tongue to be inserted in the belt buckle, a latching mechanism for the catch, a release button, a cover etc. For securing the belt buckle to the vehicle, usually either a wire cable or a metal strap is used which is secured by one end to the vehicle and by the other end to the load-bearing frame of the belt buckle.

BRIEF DESCRIPTION OF THE INVENTION

Contrary to the above, a load-bearing frame in accordance with the invention is provided with a fastener extension which is configured integrally with the frame and comprises a fastener opening for mounting the frame in a vehicle-fixed manner. Vehicle-fixed mounting is understood to mean attaching the belt buckle to a part of the vehicle. The invention is thus based on replacing the fastener element, usually provided separately for connecting the belt buckle to the vehicle, by a fastener extension configured integrally with the frame. This affords numerous benefits. For one thing costs are reduced, this being due to the fact that a fastener extension configured integrally with the frame is cheaper to manufacture than a separate fastener element, since for forming the fastener extension practically no additional work steps are needed. Furthermore, inventory and transportation costs for the additional fastener element are eliminated. In addition to this the frame of the belt buckle can be dimensioned more favorably, due to a particularly consistent flow of force materializing between the fastener extension and the frame which is not ruined by the connecting members usually provided between the fastener element and the frame, for instance, rivets or screws. As a result of this a weight reduction is achieved. Practically without any additional expense a plurality of differing fastener extensions can be achieved; since the frame is stamped from sheet metal, merely a different stamping tool is required.

Further features of the invention are set forth in the sub-claims.

BRIEF DESCRIPTION OF THE DRAWINGS

The invention will now be described with reference to the attached drawings, in which.

DETAILED DESCRIPTION OF THE INVENTION

Figure 1:
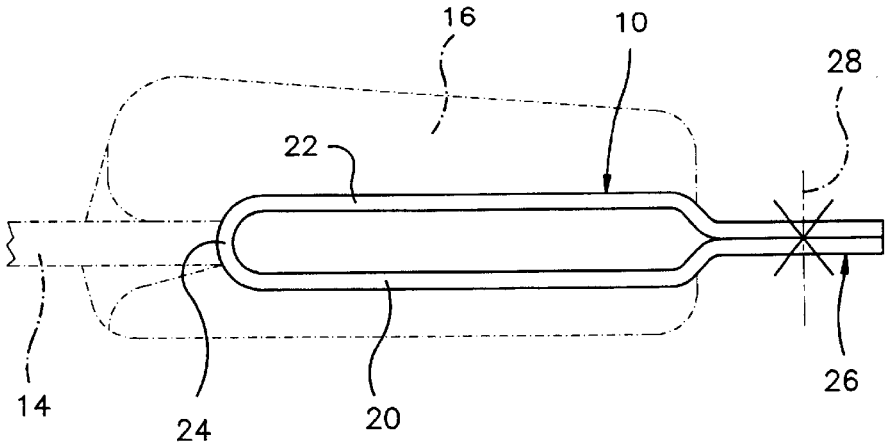
FIG. 1 illustrates a first embodiment of a frame in accordance with the invention in a schematic cross-section.

FIG. 1 illustrates in a schematic cross-section a load-bearing frame 10 in accordance with a first embodiment of the invention. This frame 10 receives an insert tongue 14 of a seat belt system (not shown). Attached to the frame 10 are the known function parts of a belt buckle, for example, the housing 16 illustrated schematically, a catch (not shown) for the insert tongue 14 as well as a release button (not shown) for the catch.

The load-bearing frame 10 is stamped from sheet metal and comprises a base plate 20 as well as a cover plate 22 which, on the side of which the insert tongue 14 is inserted, are connected integrally to each other by a bending point 24. On the side facing away from the insert tongue 14, the frame 10 is provided with a fastener extension 26 which is formed by an elongation of the base plate 20 and an elongation of the cover plate 22. The elongations of the base plate 20 and the cover plate 22 have the same length. The fastener extension 26 is provided with a fastener opening 28, illustrated schematically, in which, for example, a fastener screw can engage with which the frame can be attached fixedly to the vehicle, for example to a vehicle seat. The elongations of the base plate 20 and cover plate 22 forming the fastener extension 26 are located flat one on the other in the region of the fastener extension 26.

Figure 2:
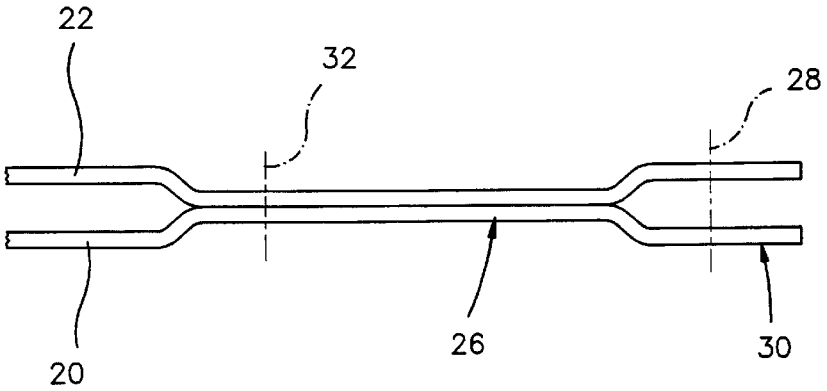
FIG. 2 illustrates a second embodiment of part of a frame in accordance the invention in a schematic side view.

FIG. 2 illustrates a second embodiment of the fastener extension of a frame in accordance with the invention. In this embodiment the fastener extension 26 is elongated to permit securing the belt buckle to a fastening point located concealed. In the case of this embodiment too, the elongations of the base plate 20 and the cover plate 22 forming the fastener extension 26 are located flat one on the other; the two extensions merely being bent in the region of the fastener opening 28 so that a symmetric fork 30 is formed.

The base plate 20 and the cover plate 22 are connected to each other at their side facing the fastener extension 26. For this purpose rivets or screws may be used which extend through an opening 32 shown schematically.

Figure 3:
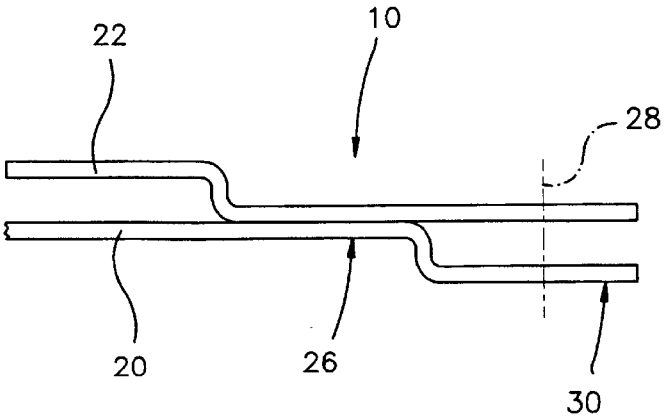
FIG. 3 illustrates a third embodiment of the invention in a view corresponding to that of FIG. 2.
Figure 1A:
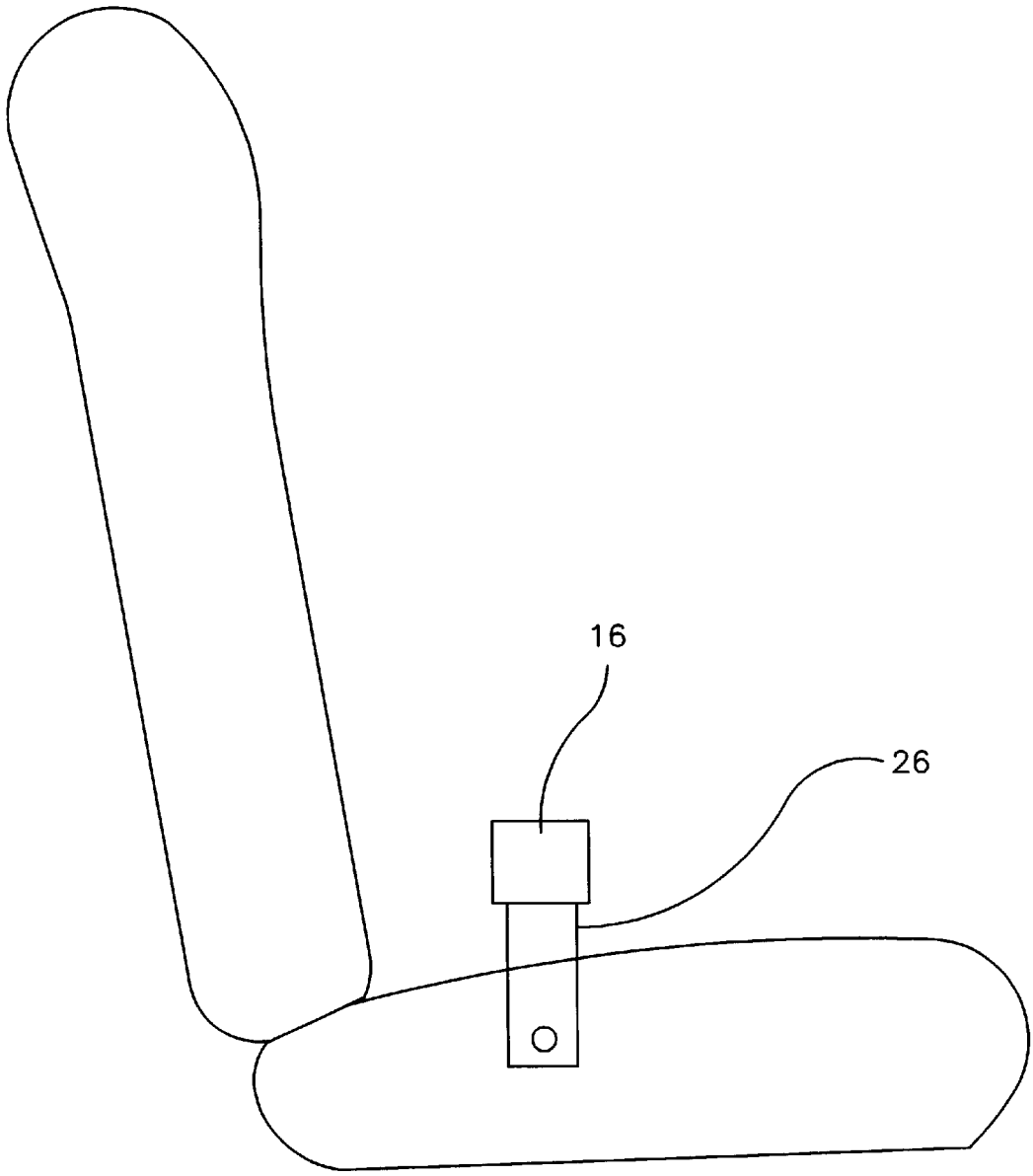
FIG. 1A illustrates a first embodiment of a frame in accordance with the invention connected to a vehicle seat.

FIG. 3 illustrates the fastener extension of a load-bearing frame in accordance with the invention according to a third embodiment. Contrary to the embodiment as illustrated in FIG. 2 in which the frame, the fastener extension 26 and the fork 30 are shown configured symmetrical to a middle plane formed by the contact plane of the two elongations of the base plate 20 and the cover plate 22 in the region of the fastener extension 26, the frame 10 and fork 30 in this embodiment are configured asymmetrically. The base plate 20 rectilinearly turns into the elongation for the fastener extension 26 whilst the cover plate 22, by means of a bend, turns into the elongation for the fastener extension 26. By contrast, the elongation of the base plate 20 for forming the fork 30 is bent, whilst the elongation of the cover plate 22 extends rectilinearly.

Figure 4:
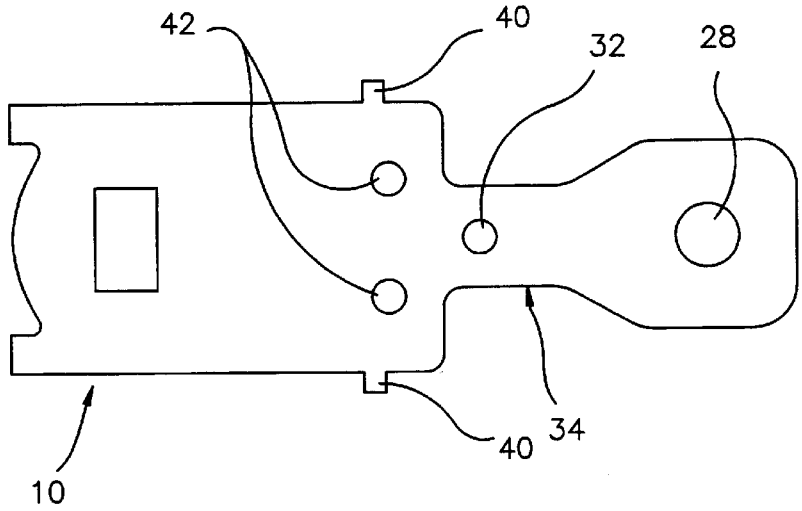
FIG. 4 illustrates a frame in accordance with the invention according to a fourth embodiment of the invention in a schematic plan view.
Figure 5:
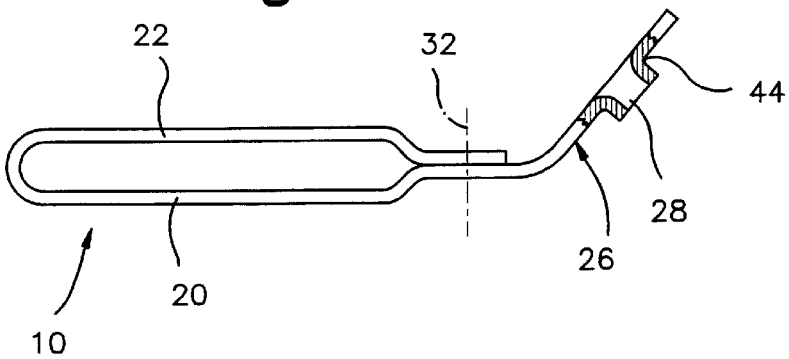
FIG. 5 illustrates a frame in accordance with the invention according to a fifth embodiment of the invention in a schematic side view.

FIGS. 4 and 5 illustrate schematically a fourth and a fifth embodiment of the frame in accordance with the invention in a plan view and a side view respectively. The fifth embodiment differs from the fourth embodiment merely by the fastener extension 26 being bent with respect to the frame. As compared to the frame shown in FIGS. 1 to 3, the fourth and fifth embodiments differ in that the fastener extension 26 is configured in a single layer, i.e. by elongation of the base plate 20. Since in these embodiments the load is introduced into the frame 10 asymmetrically from the fastener extension 26, a particularly stable connection between the base plate 20 and the cover plate 22 is needed in the region of the transition to the fastener extension 26. For this purpose, straps 40 may be provided which are formed on the base plate and are folded over into corresponding cavities in the cover plate 22. In addition, a drilled hole 32 as evident from FIGS. 1 to 3 is supplemented by additional drilled holes 42 with which the cover plate 22 can be secured connected to the base plate 20, for example, by rivets. The fastener extension 26 is provided with a constriction 34 so that a deformation zone is formed which in the case of eccentric loading of the frame is able to yield so that no displacement of the cover plate 22 materializes with respect to the base plate 20. Formed around the fastener opening 28 is a rim 44 enhancing the resistance of the fastener opening to being stripped.

Figure 6:
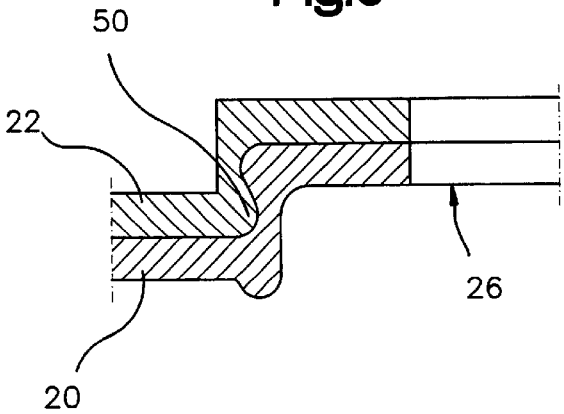
FIG. 6 illustrates a detail of a frame in accordance with the invention in a schematic side view.

FIG. 6 illustrates schematically a further kind of fastening for the cover plate 22 to the base plate 20. The base plate 20 and the cover plate 22 are bent double, an undercut being formed at the bend of the base plate into which a nose 50 formed by the bend of the cover plate 22 engages.

Figure 7:
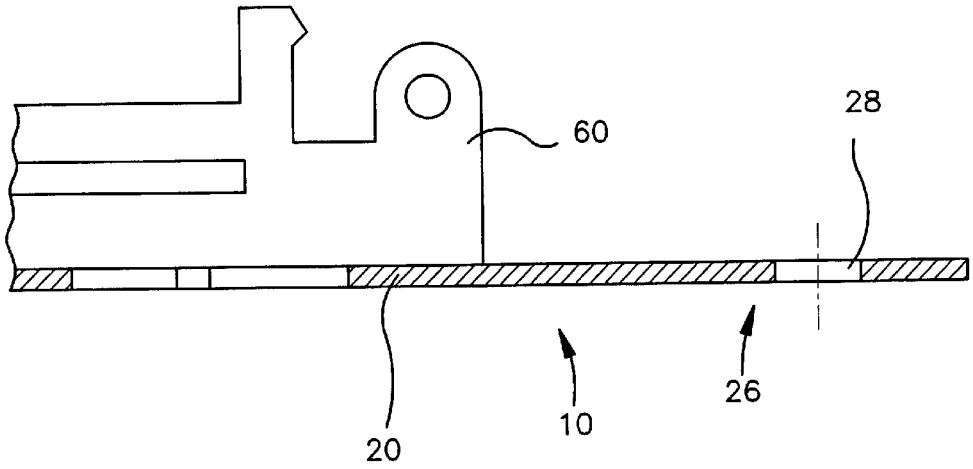
FIG. 7 illustrates a frame in accordance with the invention according to a sixth embodiment of the invention in a schematic cross-section.
Figure 8:
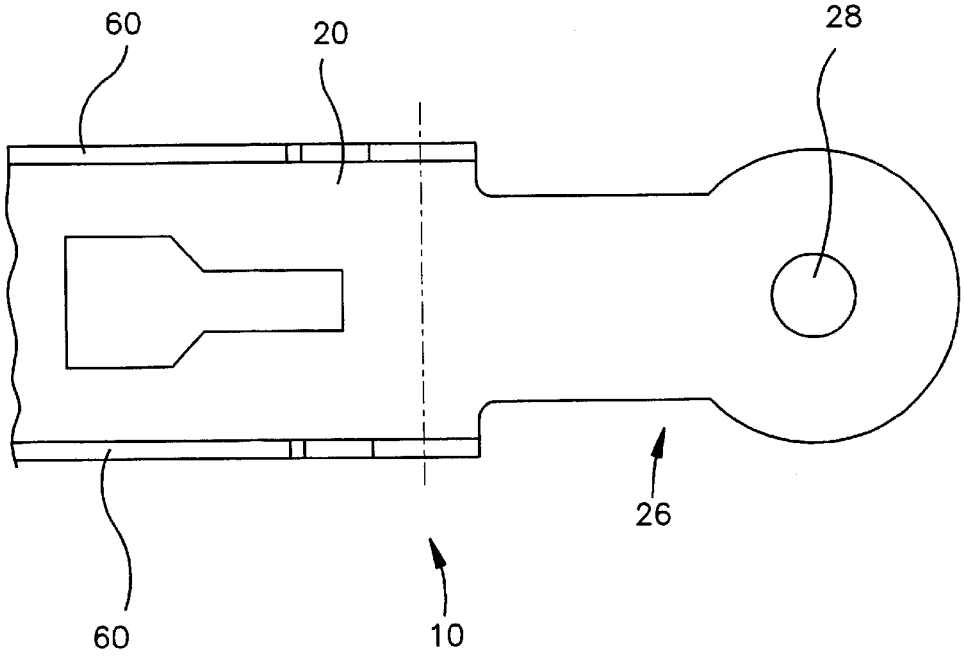
FIG. 8 is a plan view of the frame illustrated in FIG. 7.

Yet a further embodiment of the invention is illustrated schematically in FIGS. 7 and 8. In accordance with this embodiment the frame 10 comprises a base plate 20 and two side parts 60 which emanate from the base plate. In this embodiment the fastener extension 26 is configured in a single layer so that no additional fastening elements such as rivets or screws are needed.

Figure 9:
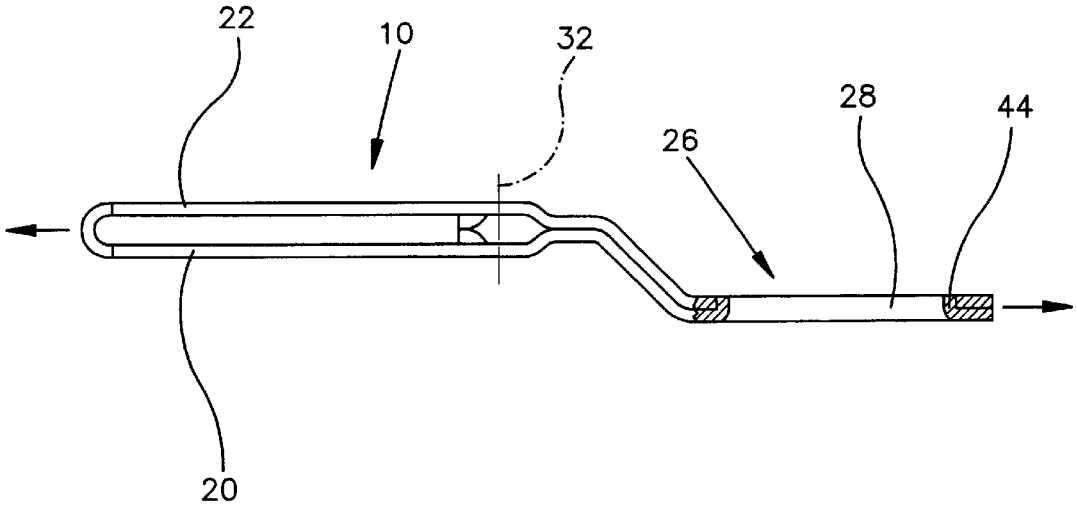
FIG. 9 illustrates a frame in accordance with the invention according to a seventh embodiment of the invention in a schematic side view.
Figure 10:
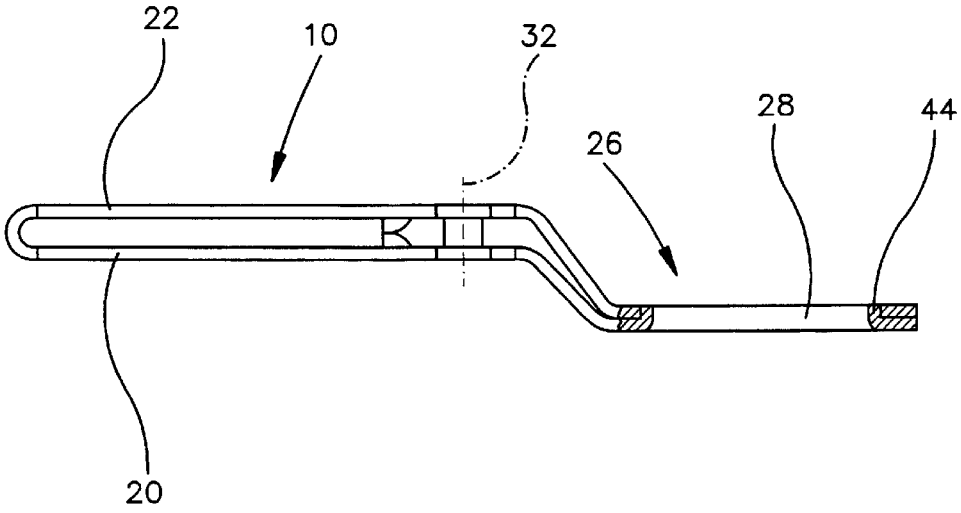
FIG. 10 illustrates a frame in accordance with the invention according to an eighth embodiment of the invention in a schematic plan view.

FIGS. 9 and 10 schematically illustrate a frame 10 in accordance with further embodiments of the invention. These embodiments mainly correspond to the embodiments shown in FIGS. 2 and 3, except that the fastener extension 26 is bent in the embodiments of FIGS. 9 and 10. The elongation of the base plate 20 in these embodiments comprises a rim 44 about the fastener opening 28, whilst the elongation of the cover plate 22 is provided with an opening which surrounds the rim 44 so that the two elongations of the base plate 20 and cover plate 22 respectively are safeguarded against relative displacements. Such displacements may occur particularly when the bent fastener extension 26 is loaded by stretching due to loading of the frame. This is indicated by the two arrows. To prevent a displacement of the cover plate 22 with respect to the base plate 20 occurring in such a loading situation, the elongations of the base plate 20 and cover plate 22 respectively in the embodiment as illustrated in FIG. 9 are configured so that they have the same length, i.e. before the elongations are bent. In the embodiment illustrated in FIG. 10, a rivet 32 is provided between the base plate and the cover plate to prevent their relative displacement.

What is claimed is:

1. A vehicle seat belt buckle fastened to a fixed part of a vehicle, said seat belt buckle comprising:

a metal load-bearing seat belt buckle frame having an integral extension and an opening in said extension, said extension extending outside a housing of said vehicle seat belt buckle such that said opening is arranged outside said housing; and a fastener extending through said opening in said extension;

said seat belt buckle frame being fastened to the fixed vehicle part by said fastener.

2. The frame of claim 1, wherein said frame is formed by a base plate and a cover plate oriented parallel thereto, said base plate and said cover plate being connected to each other integrally on a side facing away from said fastener extension.

3. The frame of claim 2, wherein said base plate and said cover plate are secured to each other at a side facing said fastener extension.

4. The frame of claim 3, wherein said base plate and said cover plate are secured to each other at said side facing said fastener extension by a rivet.

5. The frame of claim 2, wherein said fastener extension is formed by an elongation of said base plate and of said cover plate.

6. The frame of claim 5, wherein said elongation of said base plate and said elongation of said cover plate are located one on the other adjacent said fastener opening.

7. The frame of claim 5, wherein said fastener extension is formed by said elongation of said base plate and of said cover plate, said elongation of said base plate and said elongation of said cover plate having the same length.

* * * * *